US008607893B2

(12) United States Patent
Kumagai et al.

(10) Patent No.: US 8,607,893 B2
(45) Date of Patent: Dec. 17, 2013

(54) IMPACT TOOL WITH A PROTECTING COVER

(75) Inventors: Ryunosuke Kumagai, Anjo (JP); Hidenori Nagasaka, Anjo (JP); Manabu Sugimoto, Anjo (JP)

(73) Assignee: Makita Corporation, Anjo (JP)

( * ) Notice: Subject to any disclaimer, the term of this patent is extended or adjusted under 35 U.S.C. 154(b) by 394 days.

(21) Appl. No.: 13/005,976

(22) Filed: Jan. 13, 2011

(65) Prior Publication Data

US 2011/0180289 A1 Jul. 28, 2011

(30) Foreign Application Priority Data

Jan. 28, 2010 (JP) ..... 2010-017120

(51) Int. Cl.
*B25F 5/02* (2006.01)
*B25D 17/00* (2006.01)

(52) U.S. Cl.
USPC ..... 173/210; 173/93.5; 173/90; 173/217; 173/30; 310/47; 310/50

(58) Field of Classification Search
USPC ..... 173/93.5, 90, 210, 217; 310/47, 50
See application file for complete search history.

(56) References Cited

U.S. PATENT DOCUMENTS 7,108,079 B2 * 9/2006 Sakai et al. ..... 173/217
7,140,451 B2 * 11/2006 Yoshimizu et al. ..... 173/217

FOREIGN PATENT DOCUMENTS

JP A-11-309677 11/1999
JP A-2009-220272 10/2009

OTHER PUBLICATIONS

Notification of Reasons for Refusal dated Aug. 20, 2013 from Japanese Patent Application No. 2010-017120 (with English-language translation).

* cited by examiner

*Primary Examiner* — Michelle Lopez
(74) *Attorney, Agent, or Firm* — Oliff & Berridge, PLC

(57) ABSTRACT

The cover is provided with engaging pieces that engage with a recessed groove provided on the outer peripheral surface of a hammer case and hold the cover on the hammer case to prevent the cover from being detached. The cover is also provided with bumper receiving portions extending from the front end of the cover and allowing the bumper to be externally attached to the cover, and engaging claws formed on the bumper receiving portions and engaging with engaged recessed portions formed on the inner peripheral surface of the bumper for holding the bumper to prevent the bumper from being detached from the cover. The cover with the bumper attached to the bumper receiving portions is provided to the hammer case.

14 Claims, 9 Drawing Sheets

IMPACT TOOL WITH A PROTECTING COVER

This application claims the benefit of Japanese Patent Application Number 2010-017120 filed on Jan. 28, 2010, the entirety of which is incorporated by reference.

BACKGROUND OF THE INVENTION

1. Field of the Invention

The present invention relates to impact tools, such as impact drivers and impact wrenches.

2. Description of the Related Art

An impact driver, for example, includes a plastic main housing accommodating a motor, a metal front housing (e.g., hammer case) accommodating an impact mechanism, the front housing being attached to the front of the main housing, and an anvil, which is an output shaft, projecting from the front end of the front housing. Adhered on the outer peripheral surface of the front housing, which is exposed from the main housing, is a plastic cover preventing users from directly touching the front housing, which has had a temperature increase from impact operations. In front of the cover, a ring bumper, made of an elastic material such as rubber, is attached so as to prevent the front housing from directly abutting a workpiece. The cover and bumper are assembled through a mechanism in which the bumper prevents the cover from being detached. In an example as disclosed in JP-A No. 2009-220272, a bumper is engaged with the outer peripheral surface at the front end of a hammer case, which is a front housing, with the cover overlaid on the hammer case.

SUMMARY OF THE INVENTION

However, the above-described conventional impact driver requires separate assembly of the cover and bumper to the front housing, which impairs assembly efficiency. In addition, accidental detachment of the bumper from the front housing causes the cover held by the bumper to be detached from the front housing, which deteriorates attachment reliability.

The present invention provides an impact tool with a cover and a bumper that can be assembled with excellent assembly efficiency and high attachment reliability.

A first aspect of the present invention relates to an impact tool, which includes: a main housing accommodating a motor; a front housing made of metal, attached at the front of the main housing, and accommodating an impact mechanism, an output shaft projecting from the front end thereof; a cover made of cylindrical-shaped plastic for protecting the outer peripheral surface of the front housing; a bumper made of a ring-shaped elastic material and being adjacent to the front of the cover for protecting the outer peripheral surface of the front housing; a first engaging portion provided on the cover, engaging with an engaged portion formed on the outer peripheral surface of the front housing and holding the cover attached to the front housing for preventing the cover from being detached; a bumper receiving portion provided at the front end of the cover and allowing the bumper to be externally attached to the cover; and a second engaging portion provided on the bumper receiving portion, engaging with an engaged portion formed on the inner peripheral surface of the bumper and holding the bumper externally attached to the cover for preventing the bumper from being detached. The cover with the bumper attached to the bumper receiving portion is attached to the front housing.

A second aspect of the invention relates to the impact tool based on the structure of the first aspect, wherein, a pair of the first engaging portions are provided on the front end of the cover symmetrically with respect to a central axis of the cover, and a pair of the bumper receiving portions are provided symmetrically with respect to the central axis of the cover with a phase shift relative to the first engaging portions.

A third aspect of the invention relates to the impact tool based on the structures of the first and second aspects, wherein the engaged portion of the front housing is a recessed groove provided around the front housing, and the first engaging portion is an engaging piece formed along the outer surface of the front housing and includes a claw on the front end thereof, the claw engaging with the recessed groove.

In addition, it is preferable that the bumper receiving portion is formed along the outer surface of the front housing, the second engaging portion is an engaging claw projecting outwardly in the radial direction, and the engaged portion of the bumper is an engaged recessed portion with which the engaging claw engages (fourth aspect). It is also preferable that the bumper includes a first groove portion formed on the inner peripheral surface of the bumper so as to fit with the shape of the outer surface of the engaging piece (fifth aspect). Furthermore, it is preferable that the bumper includes a second groove portion formed on the inner peripheral surface of the bumper so as to fit with the shape of the outer surface of the bumper receiving portion, and the engaged recessed portion is formed in the second groove portion (sixth aspect).

According to the first aspect of the invention in which the bumper is attached to the cover, the cover can be attached together with the bumper to the front housing, thereby improving the assembly efficiency between the cover and bumper. In addition, the attached cover is held so as not to fall from the front housing, thereby improving attachment reliability of the cover and bumper.

According to the second aspect of the invention, the bumper can be externally provided on the cover using the first engaging portions in addition to the bumper receiving portions, thereby stabilizing the attached bumper with the effect of the first aspect.

According to the third aspect of the invention, the engaged portion and first engaging portion can be readily formed, and the cover can be reliably held so as not to fall from the front housing with the effect of the first or second aspects.

BRIEF DESCRIPTION OF THE DRAWINGS

An embodiment of the present invention will be described in detail based on the following figures, wherein:

FIG. 6A shows a part of an engaging piece; FIG. 6B shows the top part of a bumper receiving portion; and FIG. 6C shows a part of an engaging claw of the bumper receiving portion;

DETAILED DESCRIPTION OF THE INVENTION

An embodiment of the present invention will be described below with reference to the drawings.

Figure 1:
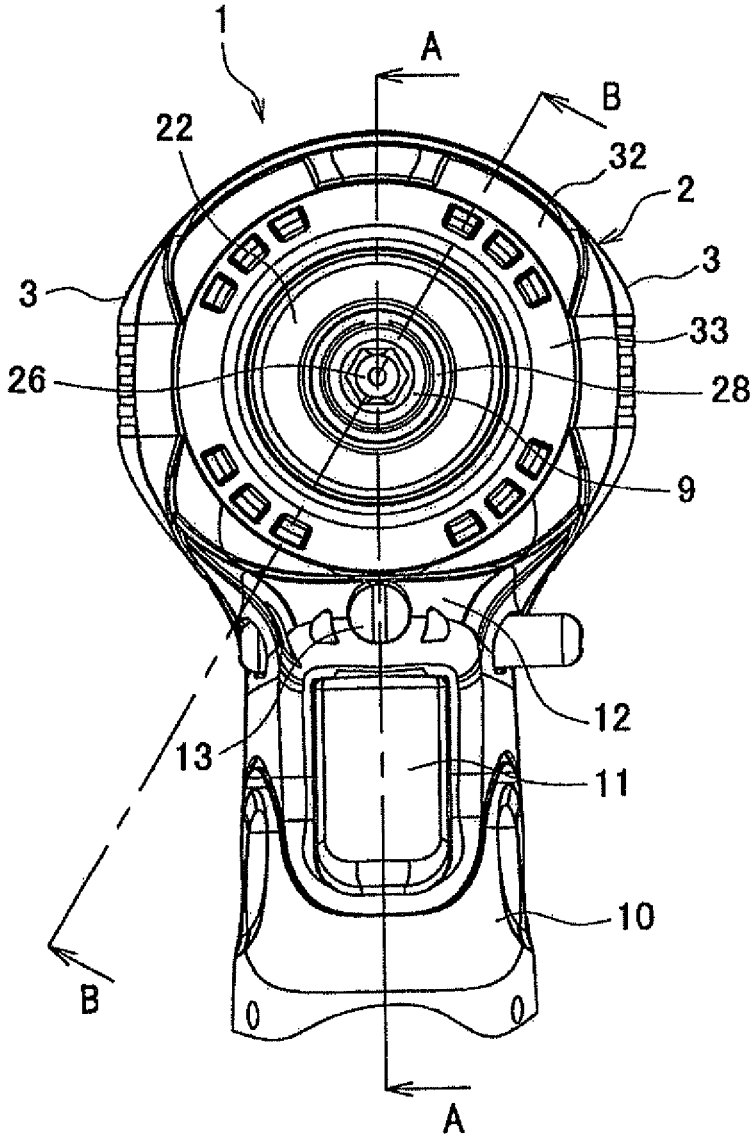
FIG. 1 is a front view of an impact driver.
Figure 2:
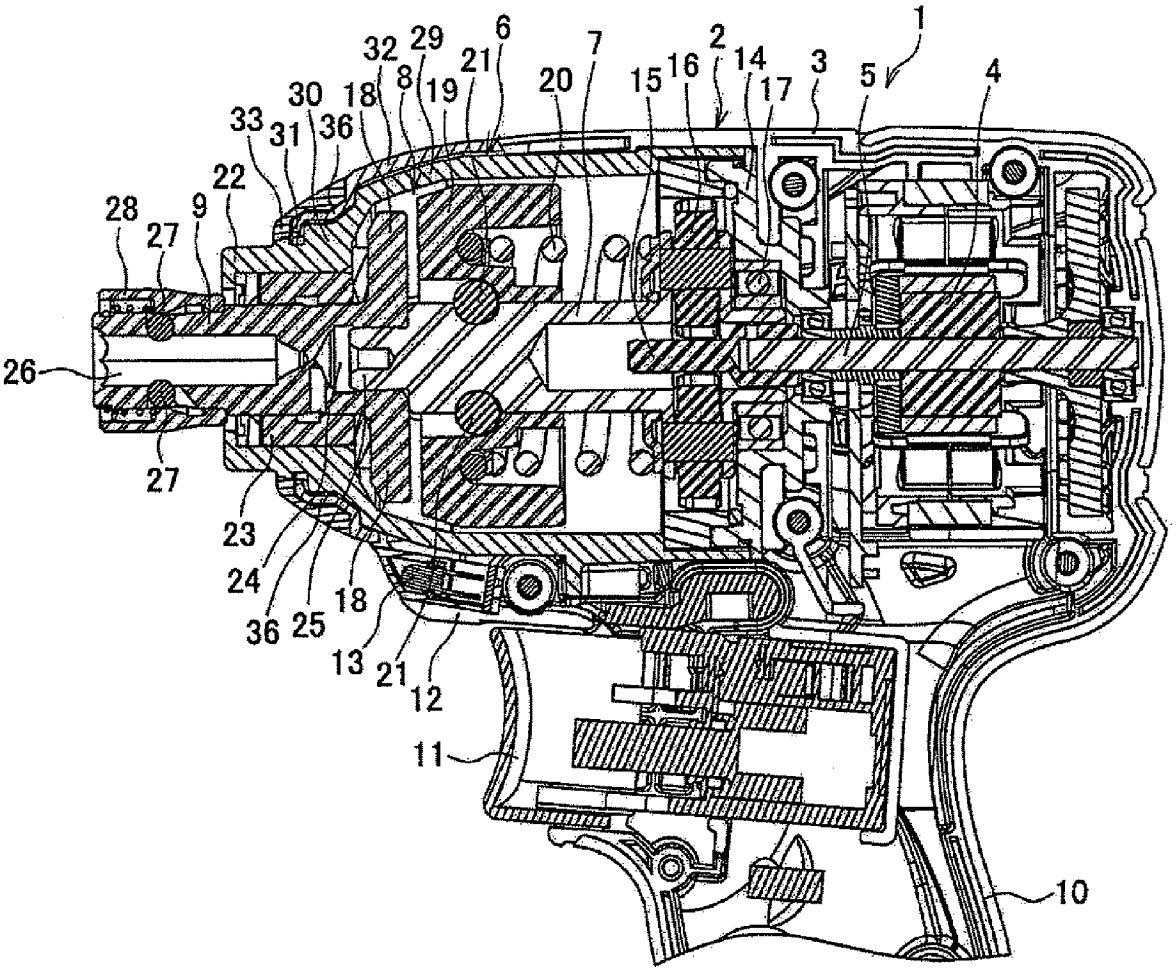
FIG. 2 is a cross-sectional view on the line A-A.
Figure 3:
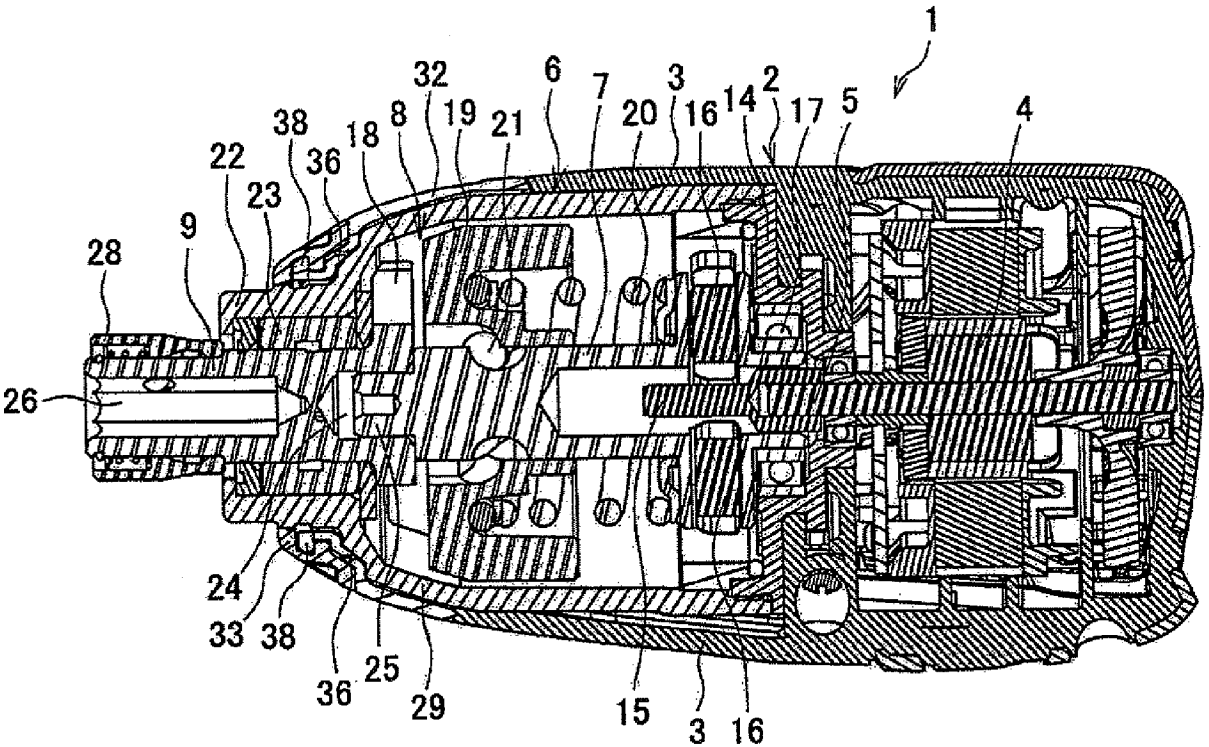
FIG. 3 is a cross-sectional view on the line B-B.

FIGS. 1 to 3 illustrate an impact driver as an example of impact tools. The impact driver 1 includes a plastic main housing 2 that is formed by assembling right and left split-half clamshells 3, 3 and accommodates a motor 4, and a metal hammer case 6 that is attached at the front (on the left side in FIGS. 2 and 3) of the main housing 2 and serves as a front housing accommodating a spindle 7, an impact mechanism 8 and an anvil 9. Extending downward from the main housing 2 is a grip handle 10 containing a battery pack (not shown), which is a power source, at the bottom. A trigger 11 is provided at the upper front of the grip handle 10. Between a lower part of the hammer case 6 and the trigger 11, an extending portion 12 is formed in the main housing 2 so as to cover the lower part of the hammer case 6. A light unit 13 facing forward of the anvil 9 is built in the front part of the extending portion 12.

An output shaft 5 of the motor 4 passes through a gear housing 14, which closes an opening at the rear end of the hammer case 6, and juts into the hammer case 6. A pinion 15 fits over one end of the output shaft 5 and meshes with two planet gears 16, 16, which are held on the outer peripheral surface of the rear part of the spindle 7. The rear end of the spindle 7 is rotatably supported by a ball bearing 17 along the central axis of the hammer case 6, the ball bearing 17 being held by the gear housing 14.

The hammer case 6 includes a pair of arms 18, 18 radially extending from the rear part of the anvil 9. The impact mechanism 8 is externally attached to the front end of the spindle 7 and includes the hammer 19 to be engaged with the arms 18, 18 and a coil spring 20 that biases the hammer 19 to an advance position where the hammer 19 and arms 18, 18 are engaged with each other. The hammer 19 is coupled to the spindle 7 with balls 21, 21 fitted between an angled groove formed by making a recess on the inner peripheral surface of the hammer 19 and a V-shaped groove formed by making a recess on the outer peripheral surface of the spindle 7.

On the other hand, the anvil 9, which serves as an output shaft of the impact mechanism 8, is rotatably supported at its middle part by a bearing 23 in a top end portion 22 that is formed at the front end of the hammer case 6 and has a uniform diameter in the front-to-back direction. The anvil 9 has a bearing hole 24, at the rear surface thereof along the central axis, into which a small diameter part 25 extending from the front end of the spindle 7 fits, to coaxially support the front end of the spindle 7.

In addition, the anvil 9 includes a bit-attachment hole 26 at the front part thereof jutting from the hammer ease 6, and a chuck mechanism including balls 27 and a sleeve 28 that prevent the bit inserted into the attachment hole 26 from being detached.

Figure 4:
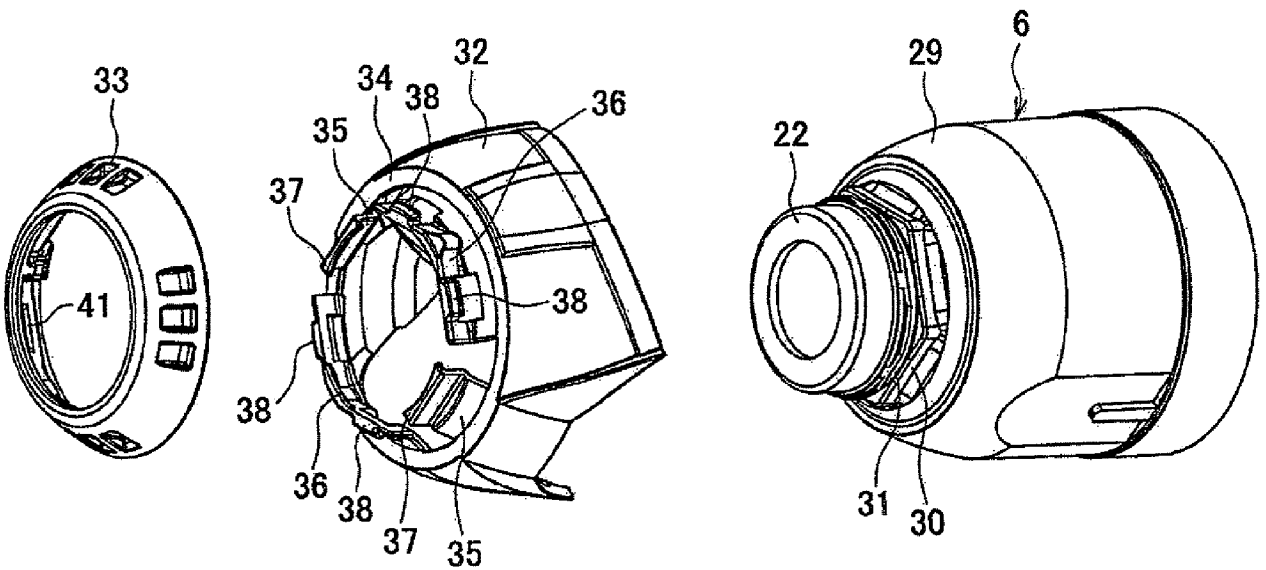
FIG. 4 is an exploded perspective view of a hammer case, a cover and a bumper.

The hammer case 6 has a cylindrical body whose rear part is inserted into the main housing 2 to be screw-coupled with the gear housing 14, and whose front part, which is exposed from the front housing 2 has a tapered portion 29 that is narrower toward the front as shown in FIG. 4. At the front end surface of the tapered portion 29, a step portion 30 is formed, that is shaped in a regular hexagon when viewed from the front and has a diameter smaller than the diameter of the front end of the tapered portion 29. The top end portion 22 is formed on the front of the step portion 30 so as to coaxially project from the step portion 30. In addition, a recessed groove 31, serving as an engaged portion, is provided in the outer peripheral surface at the rear end of the top end portion 22 and in front of the step portion 30.

Figure 5B:
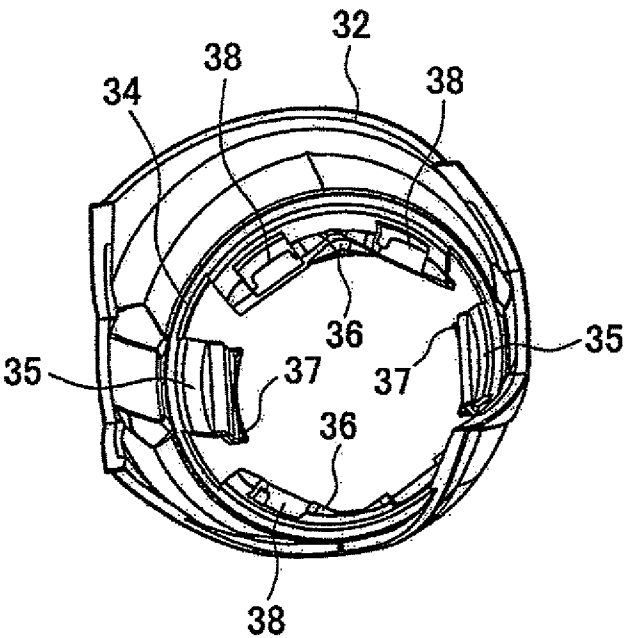
FIG. 5A is a perspective view of the cover viewed from the front and FIG. 5B is a perspective views of the cover viewed from the back.
Figure 5A:
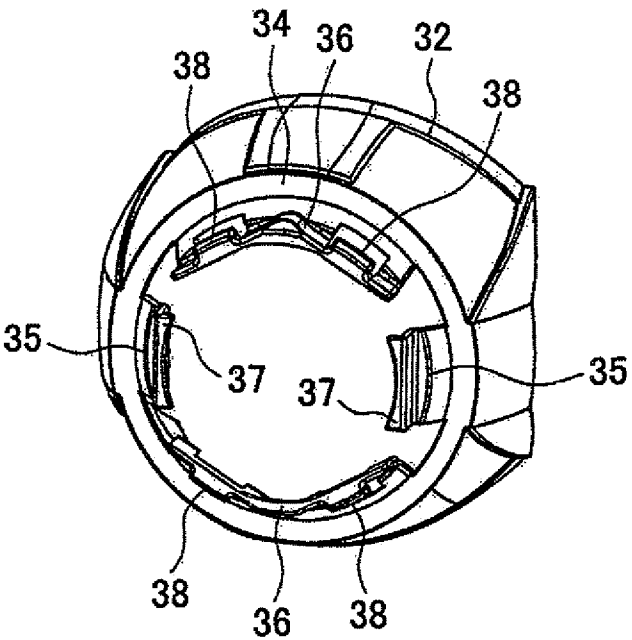

The front part of the hammer case 6, which is exposed from the main housing 2, is covered with a cover 32 and a bumper 33. The cover 32 has a plastic cylindrical body and is tapered toward the front so as to fit with the shape of the tapered portion 29 of the hammer case 6, as shown in FIGS. 4 and 5. The rear edge of the cover 32 is shaped so as to fit with the front edge of the main housing 2 that covers the rear part of the hammer case 6. Furthermore, a ring-like flange 34 is formed at the front edge of the cover 32 so as to jut toward the central axis and to engage with the front end of the tapered portion 29. Extending from the inner peripheral edge of the flange 34 are a pair of right and left engaging pieces 35, 35 and a pair of upper and lower bumper receiving portions 36, 36. The right and left engaging pieces 35, 35 are symmetric with respect to the central axis. The upper and lower bumper receiving portions 36, 36 are symmetric with respect to the central axis and 90° out of phase with respect to the engaging pieces 35, 35, respectively.

Figure 6A:
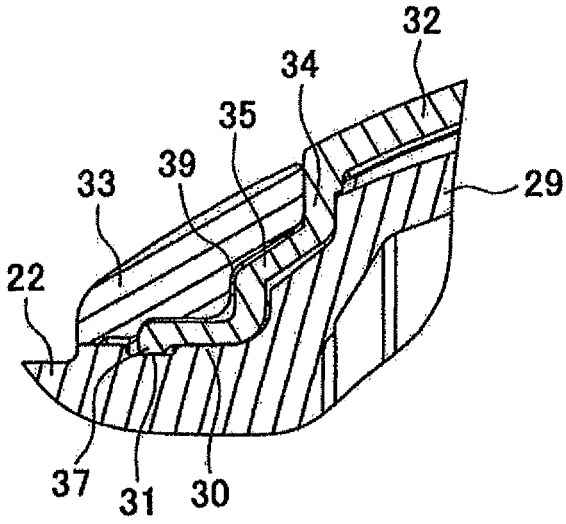
FIGS. 6A to 6C are enlarged views of parts of the cover and bumper.

The engaging pieces 35, 35, serving as first engaging portions, are formed along the outer surface of the hammer case 6 from the front end surface of the tapered portion 29 to the side surface of the step portion 30. At each front end of the engaging pieces 35, 35, as shown in FIG. 6A, a claw 37 is formed so as to bend toward the central axis to engage with the recessed groove 31 in the top end portion 22.

Figure 6B:
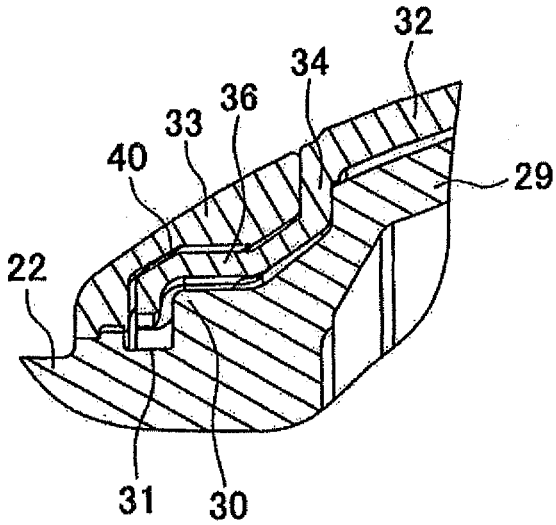
Figure 6C:
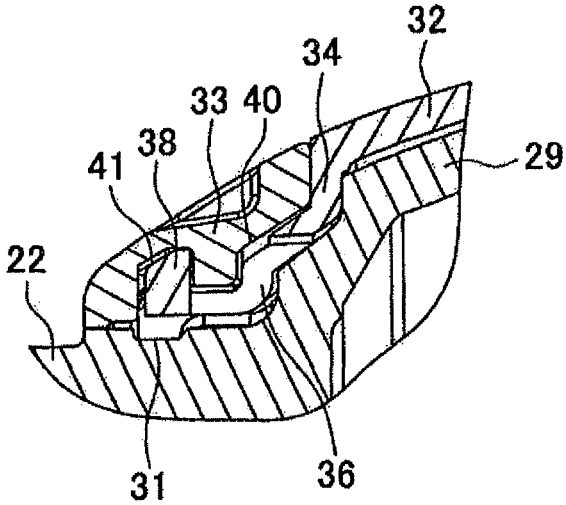

In addition, the bumper receiving portions 36, 36, as shown in FIG. 6B, are formed along the outer surface of the hammer case 6 from the front surface of the tapered portion 29 to the two adjacent sides of the step portion 30 and have a chevron shape when viewed from the front. On the outer surfaces of the right and left sides of the chevron, as shown in FIG. 6C, a pair of engaging claws 38, 38, serving as second engaging portions, are formed so as to project outwardly in the radial direction of the flange 34.

Figure 7B:
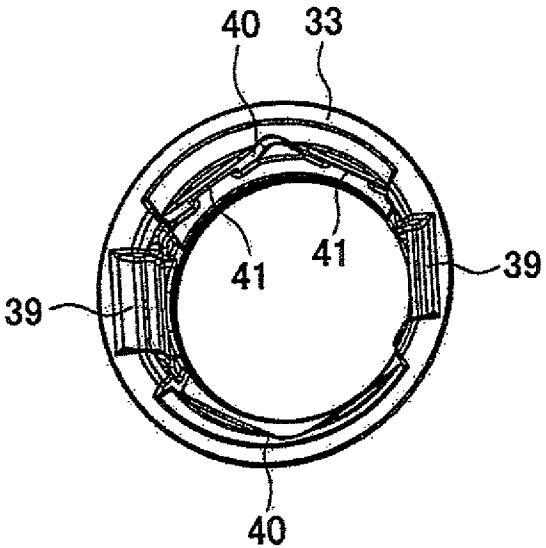
FIG. 7B is a perspective view of the bumper viewed from the back.
Figure 7A:
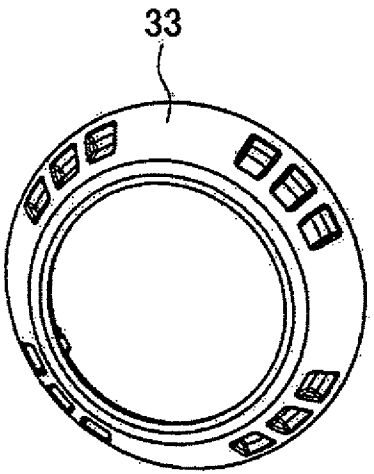
FIG. 7A is a perspective view of the bumper viewed from the front.

The bumper 33 is a rubber ring which is adjacent to the cover 32, being externally attached to the engaging pieces 35 and bumper receiving portions 36. The bumper 33 is tapered toward the front so that its outer peripheral surface continuously aligns with the outer surface of the cover 32. On the inner peripheral surface of the bumper 33, as shown in FIG. 7, a pair of right and left transverse groove portions 39, 39 are formed so as to fit with the shape of the outer surface of the engaging pieces 35, 35, and a pair of upper and lower longitudinal groove portions 40, 40 formed so as to fit with the shape of the outer surface of the bumper receiving portions 36, 36. The longitudinal groove portions 40 have a pair of engaged recessed portions 41, 41, serving as engaged portions, with which the engaging claws 38, 38 are engaged while the bumper receiving portions 36 fit in the longitudinal groove portions 40.

Figure 8B:
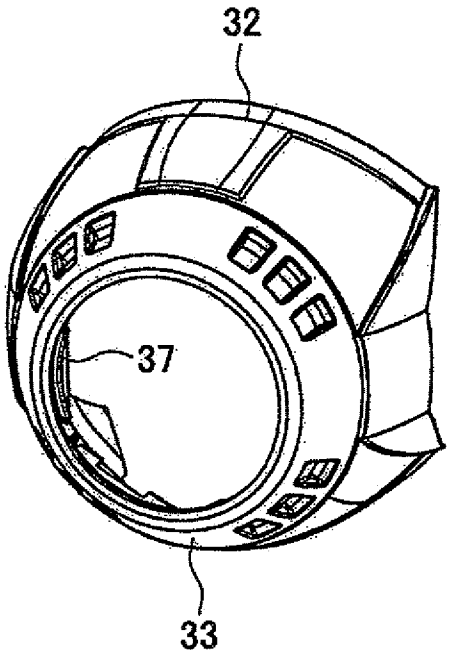
FIG. 8B is a perspective view of the cover with the bumper attached, viewed from the front.
Figure 8A:
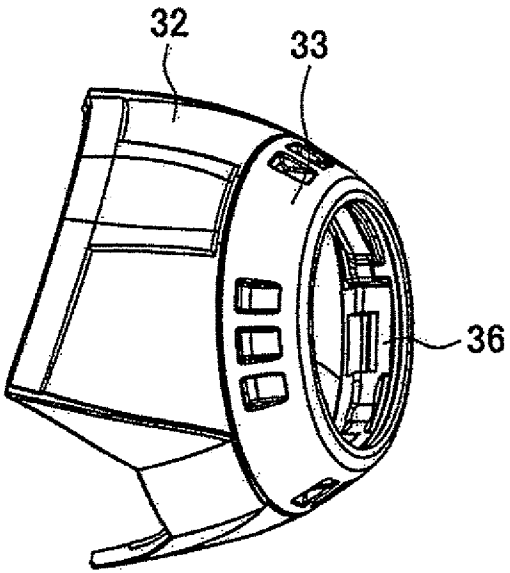
FIG. 8A is a perspective view of the cover with the bumper attached, viewed from the side.

In the assembly of the above-described impact driver 1, the hammer case 6 accommodating the spindle 7, the impact mechanism 8, the anvil 9 and other components is attached to the main housing 2, and then the cover 32 and bumper 33 are attached. In this embodiment, in order to externally attach the bumper 33 to the cover 32, at first, the transverse groove portions 39 are brought to fit with the engaging pieces 35 and the longitudinal groove portions 40 are brought to fit with the bumper receiving portions 36. This allows the engaging claws 38, 38 of the bumper receiving portions 36 to engage with the engaged recessed portions 41, 41 of the longitudinal groove portions 40, thereby the bumper 33 is attached to the front end of the adjacent cover 32 as shown in FIG. 8.

Figure 9:
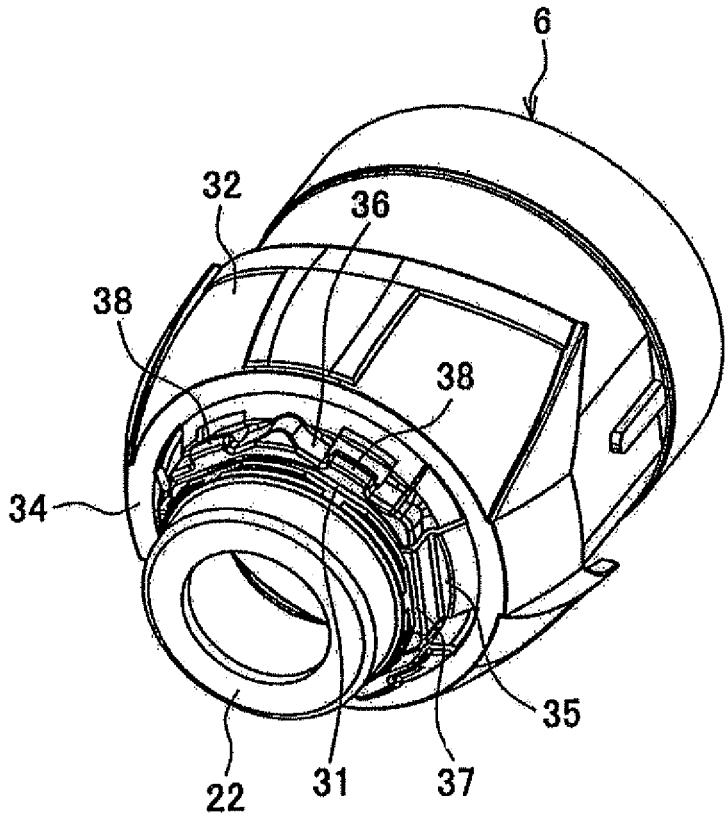
FIG. 9 is a perspective view of the assembled cover, but not shows the bumper.

The cover 32 is positioned at the upper and lower parts of the step portion 30 of the hammer case 6 so as to fit the bumper receiving portions 36, 36. The anvil 9 and top end portion 22 go through the cover 32 attached to the bumper 33. At this time, the cover 32 covers the hammer case 6. The cover 32 is then retracted until the flange 34 abuts the front end of the tapered portion 29. Thus, as shown in FIG. 9 with the bumper 33 omitted, the bumper receiving portions 36, 36 fit into the upper and lower parts of the step portion 30, while the claws 37 of the right and left engaging pieces 35, 35 of the cover 32 are engaged with the recessed groove 31 of the top end portion 22, thereby the cover 32 and bumper 33 are attached together to the hammer case 6.

As the upper and lower bumper receiving portions 36, 36 and the step portion 30 are fitted, the cover 32 is prevented from rotating. Further, the engagement of the claws 37, 37 of the engaging pieces 35, 35 with the recessed groove 31 prevents the cover 32 from falling, resulting in no accidental detachment of the cover 32. Since the bumper 33 is externally placed on the cover 32 by engaging with the engaging pieces 35 and bumper receiving portions 36, which are positioned more inwardly toward the central axis than the outer surface of the tapered portion 29, the outer surface of the bumper 33 does not jut out more than the outer surface of the tapered portion 29, but aligns continuously with the outer surface. The rear edge of the attached cover 32 meets with the front edge of the main housing 2, which prevents the hammer case 6 from being exposed.

In the operation of the impact driver 1, the motor 4 is driven by manipulating the trigger 11 provided on the grip handle 10, and then the rotation of the output shaft 5 is transmitted via the planet gears 16, 16 to the spindle 7 to rotate the spindle 7. The spindle 7 rotates the hammer 19 via the balls 21, 21 and therefore rotates the anvil 9 engaged with the hammer 19, thus enabling various operations such as screw tightening with a bit attached to the top of the anvil 9.

When the torque of the anvil 9 increases with the progress of the screw tightening, the rotation of the hammer 19 becomes out of sync with the rotation of the spindle 7. The hammer 19 is then retracted under the bias of the coil spring 20 while rotating relative to the spindle 7 with the balls 21 rolling along the V-shaped groove. When the hammer 19 is moved away from the arms 18, 18, the hammer 19 is advanced under the bias of the coil spring 20 while rotating with the balls 21 rolling toward the front end of the V-shaped groove. Then, the hammer 19 is engaged again with the arms 18, 18 to generate rotational impact force (impact). Repetition of the engagement with and disengagement from the anvil 9 retightens the screw.

With this impact generation, the impact mechanism 8 and other components generate heat that raises the temperature of the metal hammer ease 6; however, the cover 32 prevents operators from directly touching the hammer case 6, and therefore does not cause discomfort due to the heat. In addition, since the outer surface of the top end portion 22 is covered by the bumper 33, as shown in FIGS. 1 and 2, even if a bit that is tightening a screw happens to slip off from the screw head and the front surface of the hammer case 6 abuts a workpiece, the bumper 33 absorbs the shock and reduces the possibility of damaging the workpiece.

According to the impact driver 1 in the above-described embodiment, the cover 32 with the bumper 33 can be assembled together to the hammer case 6 by: providing the engaging pieces 35, to the cover 32, that engage with the recessed groove 31 formed in the outer peripheral surface of the hammer case 6 to prevent the cover 32 attached to the hammer case 6 from being detached; providing the bumper receiving portions 36 so as to extend from the front end of the cover 32, the bumper receiving portions 36 allowing the bumper 33 to externally attach to the cover 32; providing the engaging claws 38, to the bumper receiving portions 36, that engage with the engaged recessed portions 41 formed in the inner peripheral surface of the bumper 33 attached to the cover 32 to prevent the bumper 33 from being detached; and attaching the cover 32 to the hammer case 6 while the bumper 33 is attached to the bumper receiving portions 36. As a result, this provides excellent efficiency in assembly of the cover 32 and bumper 33. In addition, the attached cover 32 is prevented from being detached from the hammer case 6, which enhances attachment reliability.

Especially, in this description, a pair of the engaging pieces 35 are symmetrically formed on the front end of the cover 32 with respect to the central axis of the cover 32, and a pair of the bumper receiving portions 36 are symmetrically formed with respect to the central axis of the cover 32, out of phase with the engaging pieces 35, thereby enabling external attachment of the bumper 33 using the engaging pieces 35 in addition to the bumper receiving portions 36, and therefore stabilizing the attached bumper 33.

Furthermore, the engaged portion of the hammer case 6 is the recessed groove 31 formed around the hammer case 6, and the first engaging portions are the engaging pieces 35 formed along the outer surface of the hammer case 6 and having claws 37 that are formed at the front end of the engaging pieces 35 and engage with the recessed groove 31, which means that formation of the engaged portion and first engaging portion is easy and detachment of the cover 32 from the hammer case 6 is reliably prevented.

Note that the form of the engaged portion, the first and second engaging portions, bumper receiving portions and other components are not limited to the above-described form. For example, the engaged portion may not be in a ring shape, but may be a groove or a projection having a predetermined length along the periphery. The first engaging portions can be also modified in various ways, such as an increase in the width of the engaging pieces, an increase in the number of the engaging pieces to three or more, shortening of the length in the forward direction, and placement of the engaging pieces at the front edge of the cover. Furthermore, the bumper receiving portions are not required to be angled, but can be an arc in shape for a hammer case without the step, and can be increased in number to three or more. The second engaging portions can be also appropriately modified in form and number according to the shape of the engaged portions on the bumper. In addition, in the above embodiment, the engaging pieces serving as the first engaging portions and bumper receiving portions are formed individually; however, the engaging pieces and bumper receiving portions can be continuously formed along the outer periphery, or the bumper receiving portions can be modified so as to serve as the first engaging portions and to have claws, which engage with the outer peripheral surface of the hammer case, on the bumper receiving portions.

The present invention can be applied to front housings in various forms, for example, a front housing being entirely tapered, rather than having a front end part with a uniform diameter, and a front housing composed of two cylindrical parts, one placed in front of the other and the other part being not tapered, but having a diameter greater than the front part. Of course, the impact tool is not limited to the impact driver and can be any other types of impact tool such as an impact wrench. The assembly of the cover and bumper according to the present invention is not limitedly applied to the impact tool including the impact mechanism with the hammer, but can be applied to the impact tool including an impact mechanism with an oil unit.

It should be understood by those skilled in the art that various modifications, combinations, sub-combinations and alterations may occur depending on design requirements and other factors insofar as they are within the scope of the appended claims or the equivalents thereof.

What is claimed is:

1. An impact tool comprising:

a main housing accommodating a motor;

a front housing made of metal, attached at the front of the main housing, and accommodating an impact mechanism, an output shaft projecting from the front end thereof;

a cover made of cylindrical-shaped plastic for protecting the outer peripheral surface of the front housing;

a bumper made of a ring-shaped elastic material and being adjacent to the front of the cover for protecting the outer peripheral surface of the front housing;

at least one first engaging portion provided on the cover, engaging with an engaged portion formed on the outer peripheral surface of the front housing, and holding the cover attached to the front housing for preventing the cover from being detached;

at least one bumper receiving portion provided at the front end of the cover and allowing the bumper to be externally attached to the cover; and at least one second engaging portion provided on the at least one bumper receiving portion, engaging with an engaged portion formed on the inner peripheral surface of the bumper, and holding the bumper externally attached to the cover for preventing the bumper from being detached, wherein the cover with the bumper attached to the at least one bumper receiving portion is attached to the front housing.

2. The impact tool according to claim 1, wherein the at least one first engaging portion further comprises a plurality of first engaging portions and the at least one bumper receiving portion further comprises a plurality of bumper receiving portions, and a pair of the plurality of first engaging portions are provided on the front end of the cover symmetrically with respect to a central axis of the cover, and a pair of the plurality of bumper receiving portions are provided symmetrically with respect to the central axis of the cover and are shifted relative to the plurality of first engaging portions.

3. The impact tool according to claim 2, wherein the engaged portion of the front housing is a recessed groove provided around the front housing, and the at least one first engaging portion is an engaging piece formed along the outer surface of the front housing and includes a claw on the front end thereof, the claw engaging with the recessed groove.

4. The impact tool according to claim 2, wherein the at least one bumper receiving portion is formed along the outer surface of the front housing, the second engaging portion is an engaging claw projecting outwardly in the radial direction, and the engaged portion of the bumper is an engaged recessed portion with which the engaging claw engages.

5. The impact tool according to claim 2, wherein the plurality of first engaging portions are provided on the right and left sides of the cover, and the plurality of bumper receiving portions are provided on the upper and lower sides of the cover.

6. The impact tool according to claim 1, wherein the engaged portion of the front housing is a recessed groove provided around the front housing, and the at least one first engaging portion is an engaging piece formed along the outer surface of the front housing and includes a claw on the front end thereof, the claw engaging with the recessed groove.

7. The impact tool according to claim 6, wherein the bumper includes a first groove portion formed on the inner peripheral surface of the bumper so as to fit with the shape of the outer surface of the engaging piece.

8. The impact tool according to claim 1, wherein the at least one bumper receiving portion is formed along the outer surface of the front housing, the at least one second engaging portion is an engaging claw projecting outwardly in the radial direction, and the engaged portion of the bumper is an engaged recessed portion with which the engaging claw engages.

9. The impact tool according to claim 8, wherein the bumper includes a second groove portion formed on the inner peripheral surface of the bumper so as to fit with the shape of the outer surface of the at least one bumper receiving portion, and the engaged recessed portion is formed in the second groove portion.

10. The impact tool according to claim 1, wherein the front housing has a cylindrical body whose rear part is inserted into the main housing and is screw-coupled to a gear housing held in the main housing.

11. The impact tool according to claim 10, wherein the front housing has a tapered portion that is formed by tapering the front part of the front housing toward the front, and the cover and bumper are tapered toward the front so that the outer peripheral surfaces of the cover and bumper continuously align with the tapered portion.

12. The impact tool according to claim 11, wherein a front end portion is formed on the front end surface of the tapered portion of the front housing, the front end portion having a diameter that is smaller than the diameter of the front end of the tapered portion and uniform in the front-to-back direction, and a flange in the shape of a ring is formed on the front edge of the cover so as to project toward a central axis of the cover, the flange engaging with the front end of the tapered portion.

13. The impact tool according to claim 12, wherein the at least one first engaging portion and the at least one bumper receiving portion are formed from the flange along the outer surface of the front end portion.

14. The impact tool according to claim 10, wherein the rear edge of the cover is mated with the front edge of the main housing to prevent the front housing from being exposed.

* * * * *